US009733030B2

(12) United States Patent
Daniel et al.

(10) Patent No.: US 9,733,030 B2
(45) Date of Patent: Aug. 15, 2017

(54) MODULAR CHARGING HANDLE FOR FIREARMS

(71) Applicant: Daniel Defense, Inc., Black Creek, GA (US)

(72) Inventors: Marvin C. Daniel, Pooler, GA (US); Clinton Wade Lynch, Irmo, SC (US)

( * ) Notice: Subject to any disclaimer, the term of this patent is extended or adjusted under 35 U.S.C. 154(b) by 0 days.

(21) Appl. No.: 14/970,788

(22) Filed: Dec. 16, 2015

(65) Prior Publication Data

US 2016/0178298 A1 Jun. 23, 2016

Related U.S. Application Data

(60) Provisional application No. 62/093,781, filed on Dec. 18, 2014.

(51) Int. Cl.
*F41A 3/72* (2006.01)
*F41A 11/02* (2006.01)
*F41A 35/06* (2006.01)

(52) U.S. Cl.
CPC ..... *F41A 3/72* (2013.01); *F41A 11/02* (2013.01); *F41A 35/06* (2013.01)

(58) Field of Classification Search
CPC .... F41A 3/72; F41A 3/20; F41A 35/06; F41A 7/00
USPC ..... 89/1.4, 191.01; 42/16, 43
See application file for complete search history.

(56) References Cited

U.S. PATENT DOCUMENTS

| | | | | |
|---|---|---|---|---|
| 7,240,600 | B1 | 7/2007 | Bordson | |
| 7,707,921 | B1 | 5/2010 | Hoel | |
| 7,832,322 | B1 | 11/2010 | Hoel | |
| 7,861,635 | B1 | 1/2011 | Hoel | |
| 8,104,393 | B2 | 1/2012 | Kincel | |
| 8,336,436 | B2 | 12/2012 | Kincel | |
| 8,356,537 | B2 | 1/2013 | Kincel | |
| 8,381,628 | B1 | 2/2013 | Wheatley | |
| D694,354 | S | 11/2013 | Underwood | |
| D705,383 | S | 5/2014 | Montes | |
| D705,384 | S | 5/2014 | Underwood | |
| 8,960,066 | B2 | 2/2015 | Gomez | |
| D738,452 | S | 9/2015 | Underwood | |
| 9,175,913 | B2 | 11/2015 | Cupps | |
| 9,222,738 | B2 * | 12/2015 | Asher | F41A 35/06 |
| 9,366,489 | B1 * | 6/2016 | Strom | F41A 3/72 |
| 9,389,032 | B2 * | 7/2016 | Daley, Jr. | F41A 3/66 |
| 9,423,195 | B2 * | 8/2016 | Daley, Jr. | F41A 3/72 |
| 9,435,593 | B2 * | 9/2016 | McGinty | F41A 35/06 |
| 9,482,479 | B1 * | 11/2016 | Jen | F41A 3/72 |
| 9,488,424 | B1 * | 11/2016 | Kincel | F41A 3/72 |
| 2011/0005372 | A1 * | 1/2011 | Kincel | F41A 3/72 89/1.4 |

(Continued)

*Primary Examiner* — Michael David
(74) *Attorney, Agent, or Firm* — Merchant & Gould P.C.

(57) ABSTRACT

A modular charging handle assembly that includes a charging handle body that extends between a bolt engagement end and a pull end. The charging handle body is oriented along a longitudinal axis. The charging handle assembly also includes a base disposed at the pull end of the charging handle body and operatively connected thereto. The base includes a pair of mounting guides set on either side of the longitudinal axis to provide thereby a modular structure. The charging handle assembly also includes a pair of pull grips mateably and releasably secured to the pair of mounting guides to provide ambidextrous operating means.

10 Claims, 10 Drawing Sheets

(56) References Cited

U.S. PATENT DOCUMENTS

| | | | | |
|---|---|---|---|---|
| 2011/0174139 | A1 | 7/2011 | Olsen | |
| 2011/0214558 | A1* | 9/2011 | Kincel | F41A 9/00 89/1.4 |
| 2011/0226120 | A1* | 9/2011 | Fitzpatrick | F41A 19/47 89/1.4 |
| 2011/0265636 | A1* | 11/2011 | Overstreet | F41A 3/72 89/1.4 |
| 2012/0167433 | A1* | 7/2012 | Robbins | F41A 11/02 42/75.02 |
| 2012/0180355 | A1* | 7/2012 | Martin | F41A 3/66 42/69.01 |
| 2012/0291612 | A1* | 11/2012 | Kincel | F41A 35/06 89/1.4 |
| 2013/0092014 | A1* | 4/2013 | Kincel | F41A 3/72 89/1.4 |
| 2013/0174457 | A1* | 7/2013 | Gangl | F41A 3/72 42/16 |
| 2013/0192113 | A1* | 8/2013 | Melville | F41A 7/00 89/1.4 |
| 2014/0060293 | A1* | 3/2014 | Gomez | F41A 3/72 89/1.4 |
| 2014/0318356 | A1* | 10/2014 | Cupps | F41A 3/72 89/1.4 |

* cited by examiner

MODULAR CHARGING HANDLE FOR FIREARMS

CROSS-REFERENCE TO RELATED APPLICATION

This application claims the benefit of U.S. Provisional Patent Application No. 62/093,781, filed Dec. 18, 2014, which is entirely incorporated herein by reference.

BACKGROUND

A firearm can be comprised of a charging handle that interfaces directly or indirectly with the bolt carrier group of the weapon. The interaction of the charging handle with the bolt carrier group may be used to; cycle the bolt carrier group rearward which in turn may unload a spent casing or live cartridge from the chamber, load the weapon by releasing the bolt carrier group from the rear position and allowing the bolt carrier group to move forward to strip a loaded cartridge from the magazine into the chamber, directly or indirectly bias the hammer/fire control group into the cocked or ready position, or clear any malfunction or blockage of the operating group.

SUMMARY

In an example, the present disclosure relates to modular charging handle assembly including a charging handle body extending between a bolt engagement end and a pull end. The charging handle body is oriented along a longitudinal axis. The charging handle assembly also includes a base disposed at the pull end of the charging handle body and operatively connected thereto. The base includes a pair of mounting guides set on either side of the longitudinal axis to provide thereby a modular structure. The charging handle assembly also includes a pair of pull grips mateably and releasably secured to the pair of mounting guides to provide ambidextrous operating means.

In another example, the present disclosure relates to a method for interchangeably actuating a bolt carrier group in a firearm. The method includes translatably supporting a charging handle within the firearm along a longitudinal axis. The method also includes engaging the bolt engagement end of the charging handle with the bolt carrier group. The method further includes interchangeably securing a pair of two pull handle segments to a handle base on the charging handle.

In still another example, the present disclosure relates to a modular charging handle assembly that includes a charging handle body extending between a bolt engagement end and a pull end. The charging handle body is oriented along a longitudinal axis. The charging handle also includes a base disposed at the pull end of the charging handle body and operatively connected thereto. The base includes a pair of mounting elements set on either side of the longitudinal axis to provide thereby a modular structure. The charging handle also includes a pair of pull grips releasably secured to the pair of mounting elements of the base to provide ambidextrous operating means.

DESCRIPTION OF EXAMPLE EMBODIMENTS

Generally, an example charging handle design proposed herein allows the user to modify the size (length; shape) of a firearm's charging handle by installing differing interchangeable handle segments to a main charging handle body. This provides a charging handle that is inherently ambidextrous, without complicated mechanical parts.

Overall, example systems and methods disclosed herein include a main charging handle component, which embodies the method of attaching separate interchangeable handle segments through the use of interlocking posts and recesses, and a locking mechanism housed therein to secure the charging handle assembly in the rest position inside a firearm's upper receiver; a series of separate handle segments in varying sizes/shapes to suit the weapon user's needs or preferences, which attach to the main body through the use of interlocking posts and recesses and are securely fastened by a fastener.

Example systems and methods disclosed herein include, among others, the following features: a specially machined charging handle body, with provisions for affixing interlocking handle segments of differing length, size and shape; a locking mechanism that is movable held in the charging handle by way of a retaining device and special geometry; and a matching, recessed pocket in the firearm upper receiver to accept the locking mechanism and secure the charging handle under pressure and mechanical bias.

A user can configure a firearm based on ergonomic and mission needs or preferences, without having to invest in multiple charging handle assemblies, or aftermarket extended latches. Due to the use of the locking mechanism to secure the charging handle into the receiver, the design is completely ambidextrous and has very few moving parts. Also, the method of fixing the handle segments to the main charging handle body provides for a very robust connection, mitigating the stress on or need for pivot pins.

Figure 1:
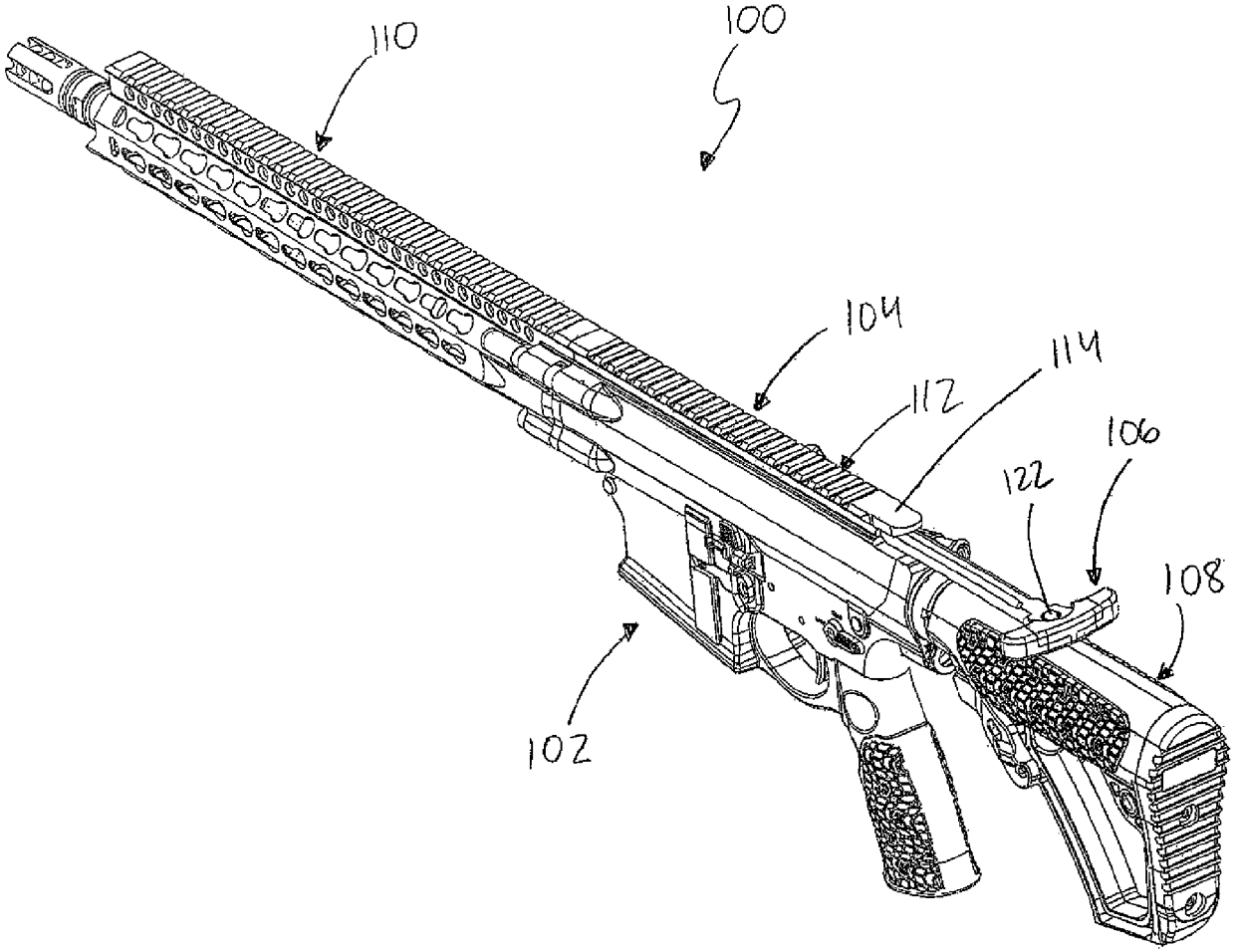
FIG. 1 is an upper rear perspective view of a firearm according to an example embodiment of the present disclosure, showing an example charging handle in an unlocked position.

FIG. 1 illustrates an example firearm 100 with a barrel section 110, a lower receiver 102, an upper receiver 104, a mounting rail 112 a butt stock 108 and a charging handle 106. The illustrated firearm 100 can be any type of firearm which utilizes a charging handle for loading, unloading and malfunction clearance, for example a Modern Sporting Rifle (i.e., AR-10/AR-15) with a bolt carrier group.

The illustrated mounting rail 112 extends on top of the firearm 100 and includes a distal region extending across the barrel section 110 and a proximal region extending across the upper receiver 104. The illustrated mounting rail 112 includes a ledge 114 positioned at the proximal region, under which the charging handle 106 translates distally and proximally with respect to the firearm 100.

The illustrated charging handle 106 includes a locking feature 122 which releasably locks the charging handle in a fixed position proximal to the ledge 114 on the mounting rail 112. An example of the locking feature 122 can include a spring-biased ball detent. The illustrated locking feature 122 is not in a locked position with respect to the ledge 114 of the mounting rail 114, and the charging handle 106 is pulled in a proximal direction in an unlocked state.

Figure 2:
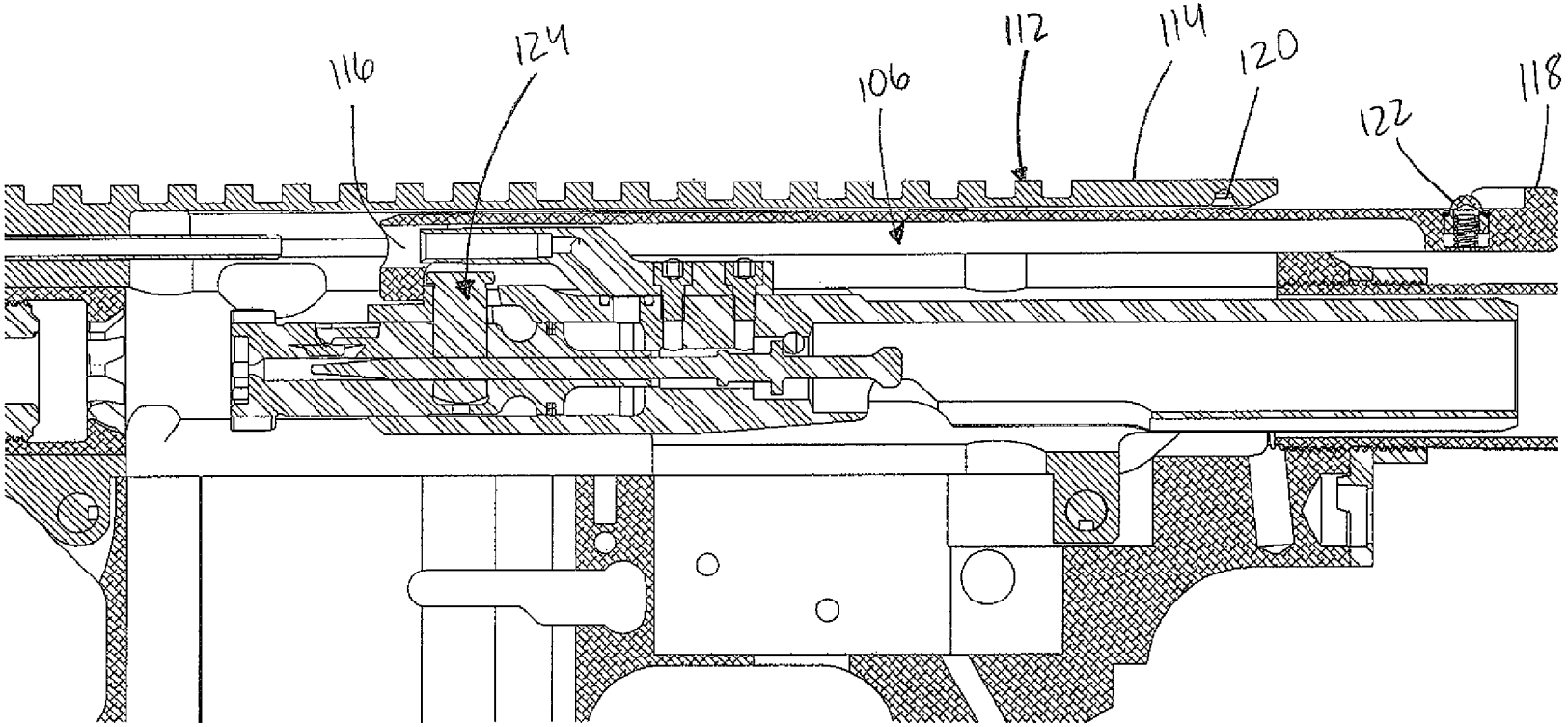
FIG. 2 is a side cross-sectional view of the firearm shown in FIG. 1, isolating and enlarging example upper and lower receivers and the example charging handle in an unlocked position.

FIG. 2 is an isolated side cross-sectional view of the example charging handle 106 translatably positioned underneath the ledge 114 of the mounting rail 112. The illustrated charging handle 106 includes an engagement end 116 and a pull end 118. The illustrated engagement end 116 can have a shape and geometry resembling an underhang. The illustrated engagement end 116 engages a bolt carrier group 124 that is translatably supported within the upper receiver 104 of the firearm 100. As illustrated, when the charging handle 106 is translated proximally in an unlocked position, the engagement end 116 engages a distal end of the bolt carrier group 124 and forces the bolt carrier croup in a proximal direction to load a live cartridge round, unload a spent shell casing and/or clear any malfunctioning aspects within the upper receiver 104. An example of the illustrated bolt carrier group 124 can be a bolt carrier group which functions within a bolt-operable firearm, for example a Modern Sporting Rifle (i.e., AR-10/AR-15).

The locking feature 122 is illustrated to be positioned distally adjacent to the pull end 118. As illustrated, the underside of the ledge 1114 of the mounting rail 112 includes a receiver 120 (or pocket) for releasably receiving the locking feature 122 when the charging handle 106 is translated proximally. An example shape or geometry of the illustrated receiver 120 can be a recessed and rounded cup into which the locking feature 122 can resiliently fit. As illustrated, the charging handle 106 is in an unlocked position and pulled proximally, so the locking feature 122 is removed from the receiver 120.

Figure 3:
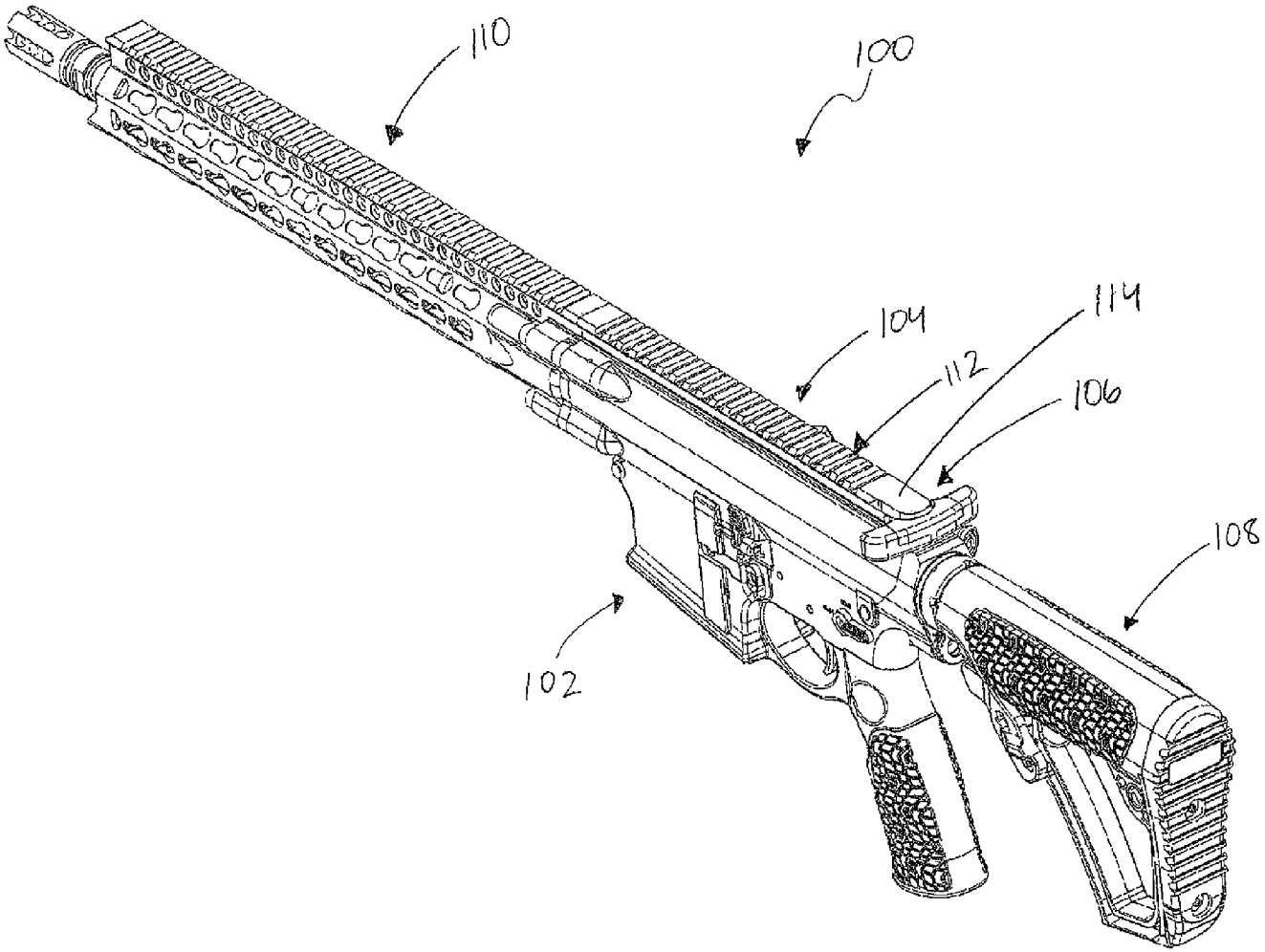
FIG. 3 is an upper rear perspective view of the firearm shown in FIG. 1, showing the example charging handle in a locked position.

FIG. 3 shows an upper perspective view of the example firearm 100 with the charging handle 106 in a locked position. The example firearm 100 has the barrel region 110, the buttstock 108, the lower receiver 102, the upper receiver 104 and the mounting rail with the ledge 114. As illustrated, the charging handle 106 is translated distally within the upper receiver 104 underneath the mounting rail 112.

Figure 4:
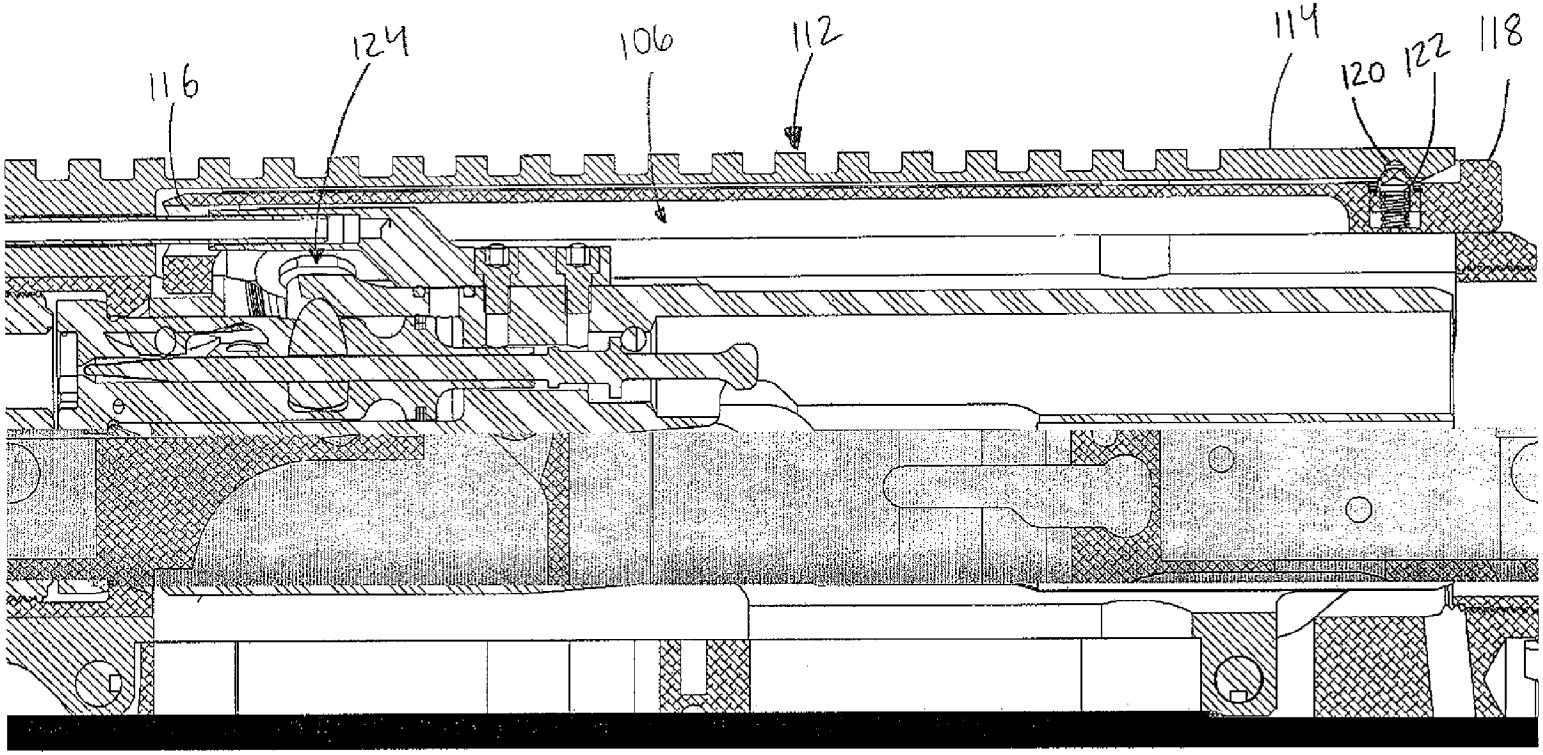
FIG. 4 is a side cross-sectional view of the firearm shown in FIG. 3, isolating and enlarging example upper and lower receivers and the example charging handle in a locked position.

FIG. 4 is an isolated side cross-sectional view of the example charging handle 106 translatably positioned underneath the mounting rail 112 with the charging handle in a locked position as described in FIG. 3. The illustrated charging handle 106 includes the engagement end 116, the pull end 118 and the locking feature 122. The illustrated mounting rail 112 includes the ledge 114 and the receiver 120 positioned on the underside of the ledge. As illustrated, in the locked position, the charging handle 106 is translated distally such that the engagement end 116 releases proximal pressure from the bolt carrier group 124 and the locking feature 122 is releasably inserted within the receiver 120. The charging handle 106 is put in this locked position after the bolt carrier 124 has loaded a live cartridge round and/or unloaded a shell casing and the firearm 100 is in use.

Figure 5:
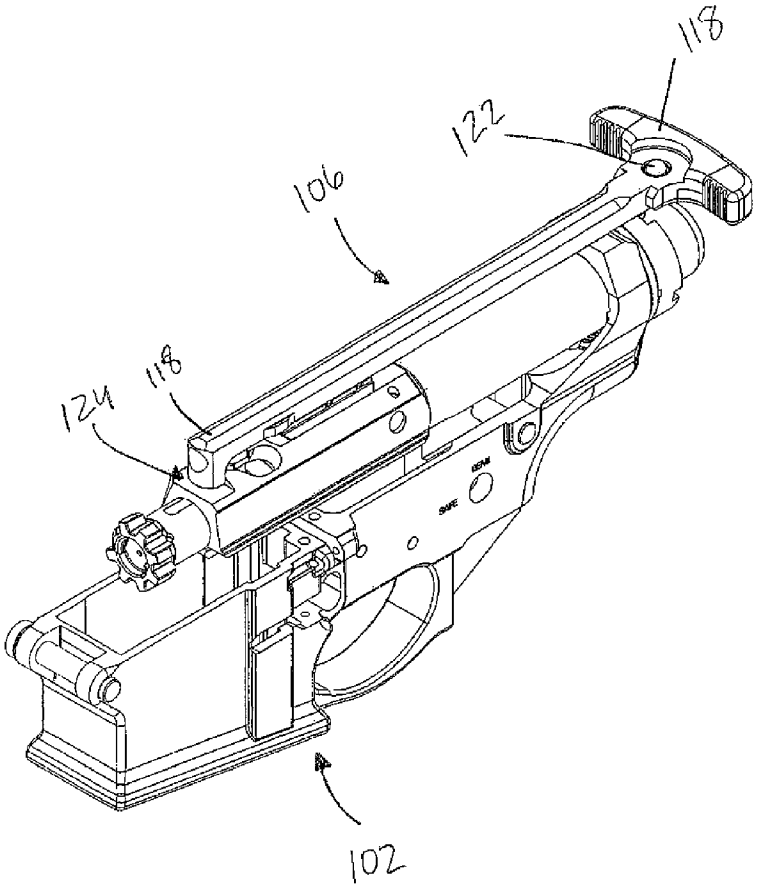
FIG. 5 is an upper perspective view of the example lower receiver, an example bolt carrier group and the example charging handle of the firearm shown in FIG. 1, showing the firearm without an example barrel, upper receiver and butt stock.

FIG. 5 shows an upper perspective view of the example lower receiver 102, the example bolt carrier group 124 and the example charging handle 106 of the firearm 100 described in FIG. 1 without the barrel region 110, mounting rail 112, upper receiver 104 and butt stock 108. The illustrated charging handle 106 includes the engagement end 118, the pull end 118 and the locking feature 122. The illustrated engagement end 118 of the charging handle 106 is in active engagement with the bolt carrier group 124 to translate both in a proximal direction, as described with respect to the unlocked position in FIGS. 1 & 2.

Figure 6:
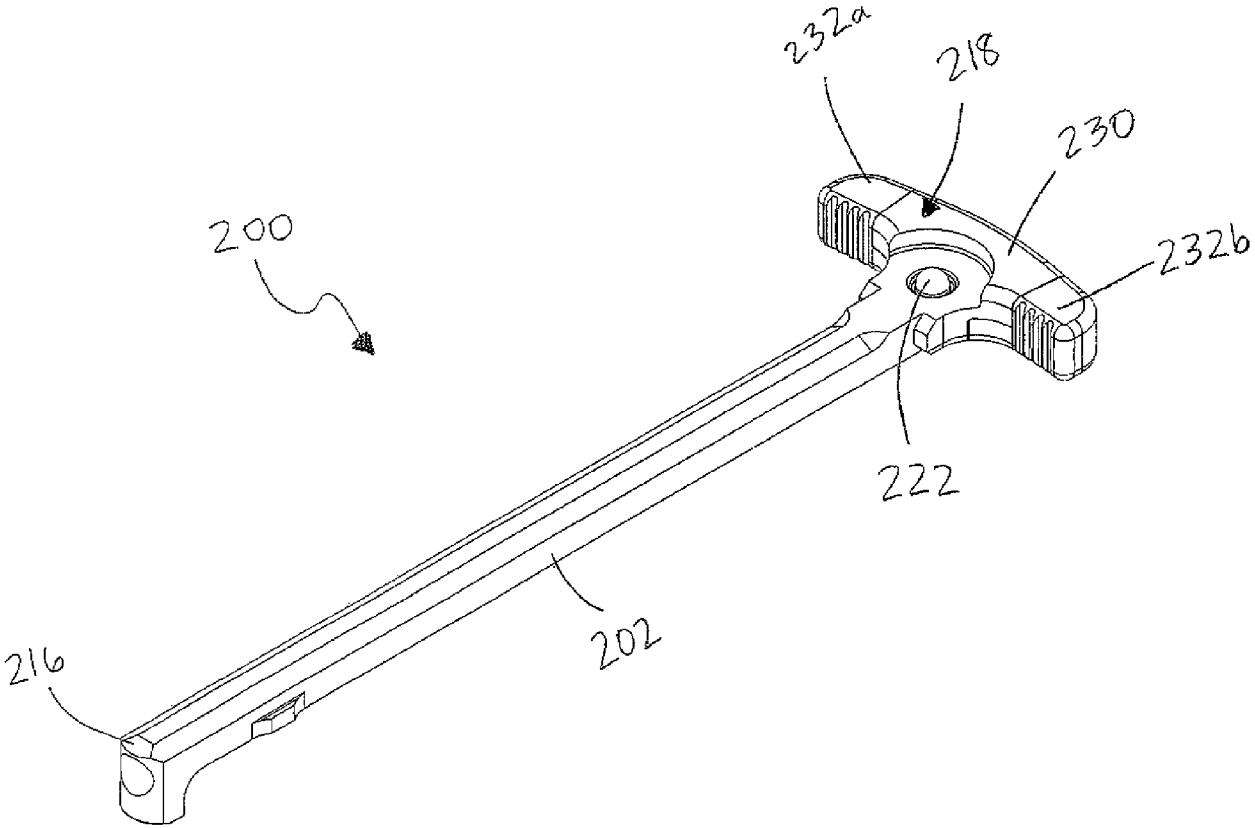
FIG. 6 is a distal upper perspective view of a modular charging handle according to another example embodiment of the present disclosure.

FIG. 6 shows a distal upper perspective view of an example modular charging handle 200 for use in translating a bolt carrier group in a firearm, for example as described in FIGS. 1-5. The illustrated modular charging handle 200 includes an elongated body 202 extending between a distal engagement end 216 and a proximal pull end 218. The elongated body 202 is oriented along a longitudinal axis extending therethrough. Similarly to the described example in FIGS. 2, 4 & 5, the engagement end 216 can have a geometry and shape which enables engagement with a bolt carrier group. An example geometry or shape of the engagement end 216 can include an underhang or lip with a proximally-facing bumper surface.

Similarly to the described example in FIGS. 1-5, the illustrated pull end 218 is positioned proximally opposite the distal engagement end 216. The illustrated pull end 218 can include a handle base 230 integrally connected to the elongated body 202. The illustrated handle base 230 can have a shape and geometry sufficient to interchangeably receive and support a plurality of interchangeable pull grips (or handle segments) which provide ergonomic operability. Example pull grips 232*a*, 232*b* (or handle segments) are illustrated to be interchangeably received and supported by the handle base 230.

Similarly to the example described in FIGS. 1-6, the illustrated charging handle 200 includes a locking feature 222 for releasable engagement with a locking receiver positioned within an upper receiver of a firearm. The illustrated locking feature 222 can be distally adjacent to the proximal pull end 218. The illustrated locking feature 222 can have a shape and function resembling a spring-biased ball detent.

Figure 7:
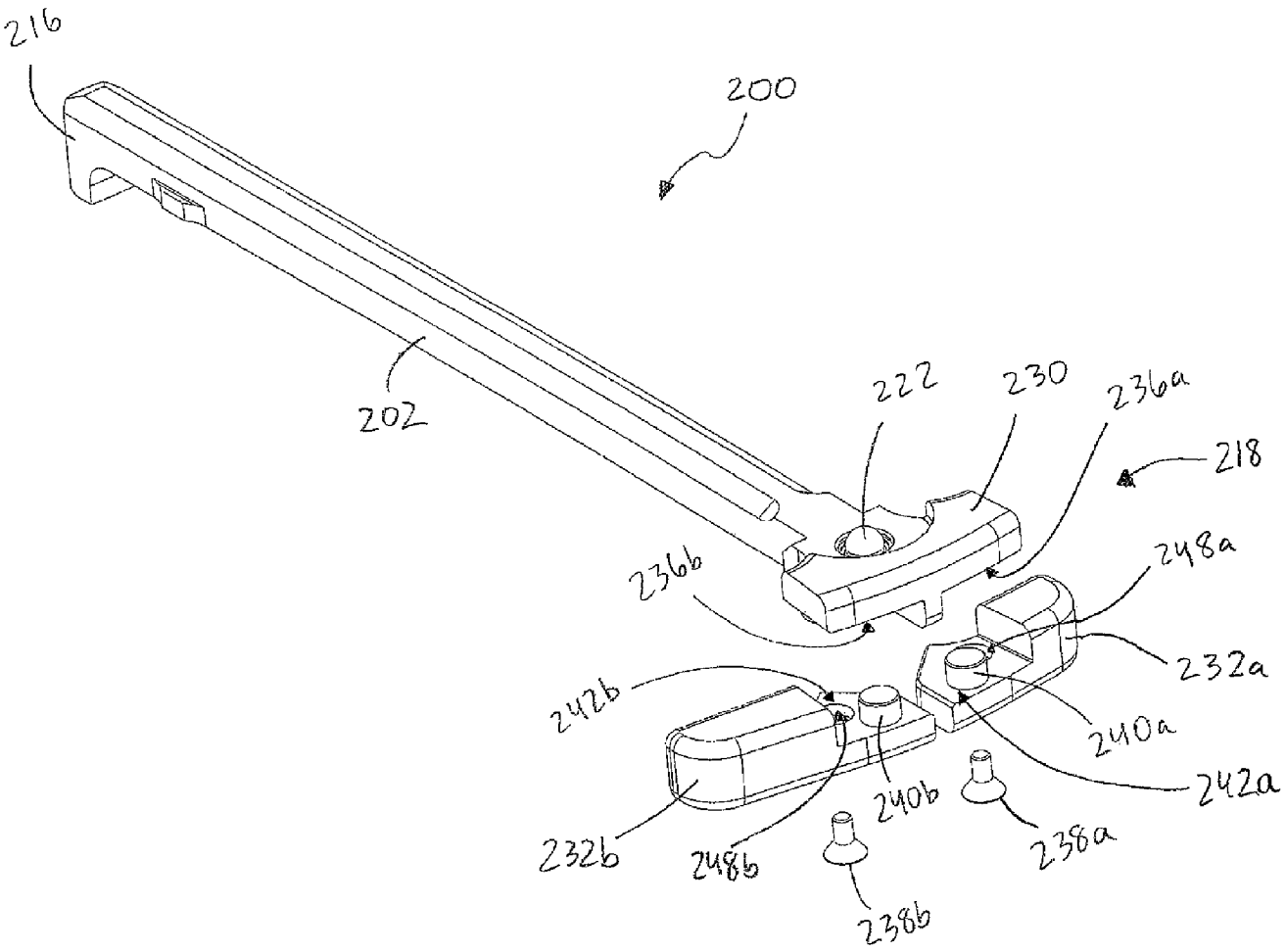
FIG. 7 is a proximal upper perspective view of the modular charging handle shown in FIG. 6, showing a first and second example handles exploded from the proximal end of the modular charging handle.

FIG. 7 shows a proximal upper perspective view of the example charging handle 200 shown in FIG. 6 with the example pull grips 232*a*, 232*b* removed from the handle base 230. As illustrated the charging handle 200 includes the elongated body 202 extending between the distal engagement end 216 and the proximal pull end 218. The locking feature 222 is positioned distally adjacent to the proximal pull end 218.

The illustrated handle base 230 can have a pair of guide regions 236*a*, 236*b* for receiving one or more interchangeable pull grips, for example the illustrated pull grips 232*a*, 232*b*.

The illustrated pull grips 232*a*, 232*b* can each have a mounting region 242*a*, 242*b* with a shape and geometry to releasably secure within one of the guide regions 236*a*, 236*b* of the handle base 230. The illustrated mounting regions

242*a*, 242*b* can each have a plug insert 240*a*, 240*b* and a fastener aperture 248*a*, 248*b*. The illustrated plug inserts 240*a*, 240*b* can have a geometry or shape to releasably insert within a bore, for example a bore set within the handle base 230, as described further below. The illustrated pull grips 232*a*, 232*b* can additionally releasably secure to the guide regions 236*a*, 236*b* of the handle base 230 through a pair of fasteners 238*a*, 238*b* which extend through the fastener apertures 248*a*, 248*b* in the pull grips and releasably secure within fastener receivers in the handle base, as described further below.

Figure 8:
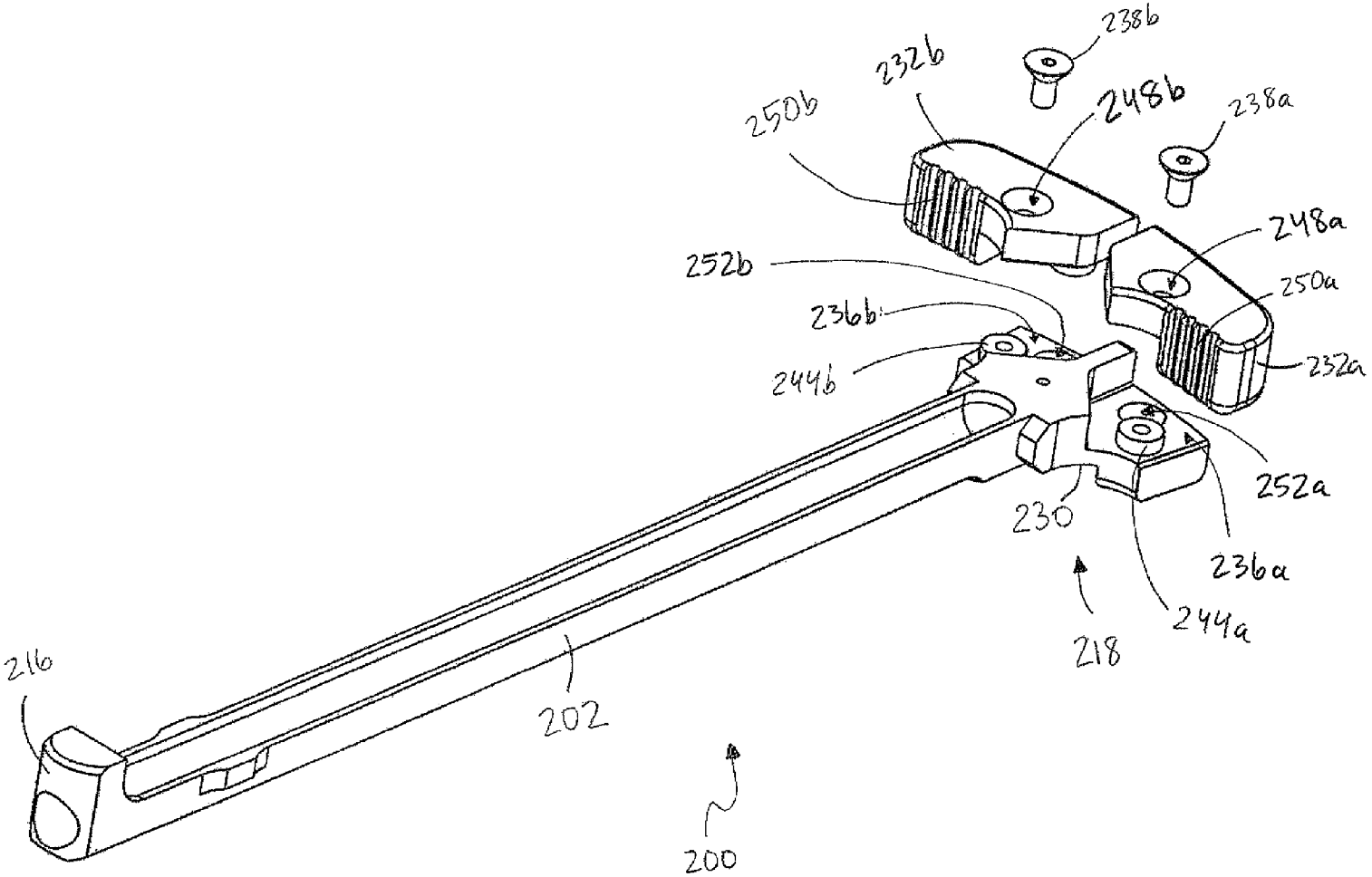
FIG. 8 is a distal underneath perspective view of the modular charging handle and exploded first and second example handles shown in FIG. 7.

FIG. 8 shows a distal underside perspective view of the example charging handle 200. As illustrated, the charging handle 200 includes the elongated body 202 extending between the distal engagement end 216 and the proximal pull end 218.

As illustrated, the charging handle 200 includes a handle base 230 at the pull end 218. The illustrated handle base 230 includes the pair of mounting regions 242*a*, 242*b* positioned on the underside of the handle base. Each illustrated guide region 236*a*, 236*b* includes a fastener receiver 244*a*, 244*b* oriented to releasably receive the pair of fasteners 238*a*, 238*b*. An example shape or geometry of the illustrated fastener receivers 244*a*, 244*b* can be an insert protruding from the surface of the handle base 230 and including a fastener receiving aperture extending therein. Each illustrated mounting region 242*a*, 242*b* can also include a bore 252*a*, 252*b* positioned adjacent the fastener receivers 244*a*, 244*b* in the mounting regions 242*a*, 242*b*. The illustrated bores 252*a*, 252*b* have a geometry or shape that can releasably receive the plug inserts 240*a*, 240*b* from the pull grips 232*a*, 232*b*. In an example orientation, the illustrated bores 252*a*, 252*b* can be positioned inwardly on the mounting regions 242*a*, 242*b* and the illustrated fastener receivers 244*a*, 244*a* can be positioned outwardly from the bores.

As illustrated, the example pull grips 232*a*, 232*b* include fastener apertures 248*a*, 248*b* which allow the fasteners 238*a*, 238*b* to pass therethrough in order to releasably secure within the fastener receivers 244*a*, 244*b* in the handle base 230. In use, the pull grips 232*a*, 232*b* are aligned with the handle base 230 such that the guide regions 236*a*, 236*b* of the handle base are aligned with and receive the mounting regions 242*a*, 242*b* of a corresponding pull grip. The plug inserts 240*a*, 240*b* on the pull grips 232*a*, 232*b* are inserted into the bores 252*a*, 252*b* on the handle base 230. The fastener apertures 248*a*, 248*b* on the pull grips 232*a*, 232*b* are aligned over, and can receive the fastener receivers 244*a*, 244*b* on the handle base 230. Once the pull grips 232*a*, 232*b* are aligned and set in corresponding guide regions 236*a*, 236*b* on the handle base 230, the fasteners 238*a*, 238*b* can be inserted through the fastener apertures 248*a*, 248*b* in the pull grips 232*a*, 232*b* and are secured within the fastener receivers 244*a*, 244*b* on the handle base 230.

The illustrated fasteners 238*a*, 238*b* can be screws with a threaded surface. The illustrated fastener receivers 244*a*, 244*b* on the handle base 230 can have an internal threaded surface that corresponds to a threaded surface on the fasteners 238*a*, 238*b*.

The illustrated pull grips 232*a*, 232*b* can have a distally-facing grip surface 250*a*, 250*b* which is ergonomically friendly to a user's fingers and provides sufficient friction to ensure that a user's fingers do not slip when a proximal pulling force is applied to the charging handle 200.

Figure 9:
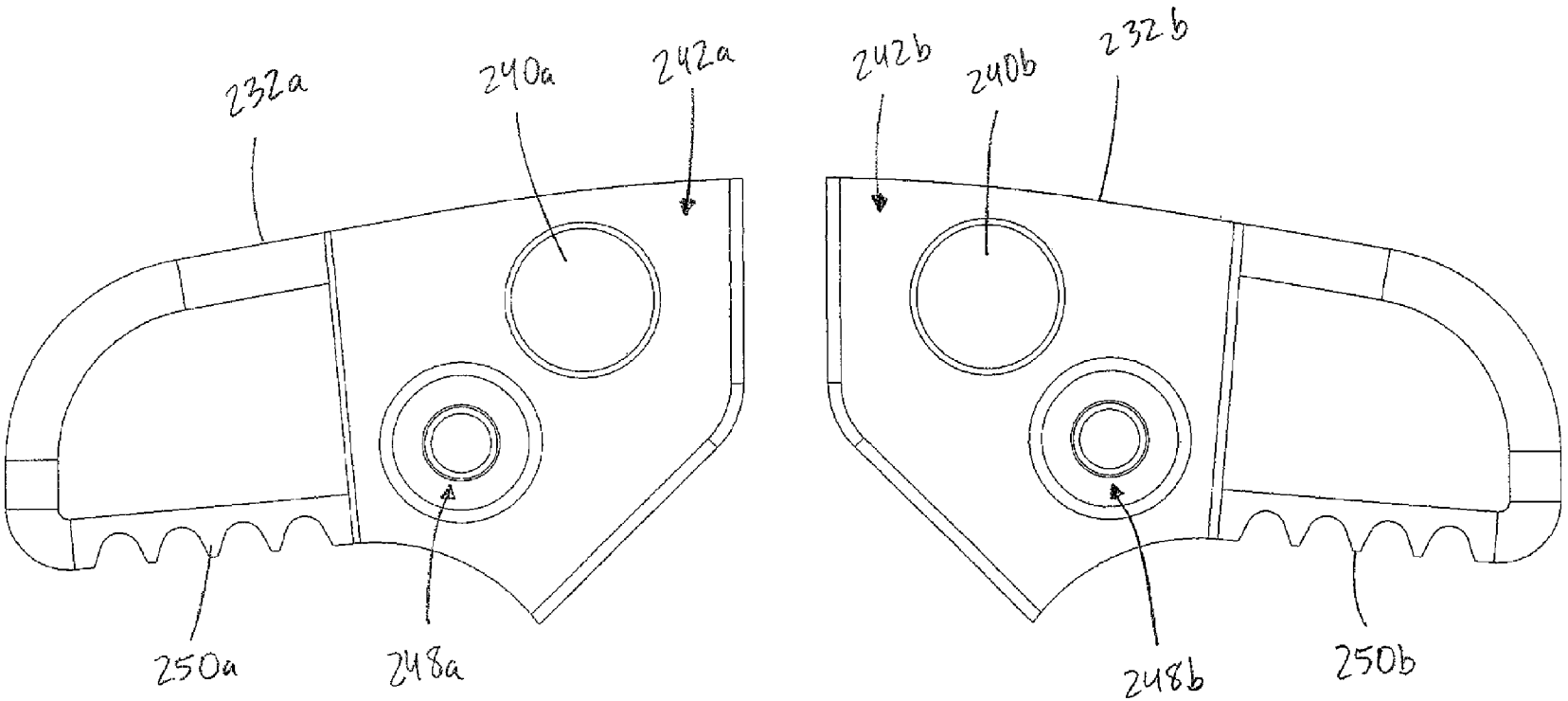
FIG. 9 is an isolated and enlarged top view of the first and second example handles shown in FIG. 7.

FIG. 9 shows an underside view of the example pull grips 232*a*, 232*b* described in FIGS. 6-8. As illustrated, the example pull grips 232*a*, 232*b* show the mounting regions 242*a*, 242*b* (or structures), the fastener apertures 248*a*, 248*b*, the plug inserts 240*a*, 240*b* and the grip surfaces 250*a*, 250*b*. The illustrated pull grips 232*a*, 232*b* can be oriented such that the plug inserts 240*a*, 240*b* are positioned closer to each other than the fastener apertures 248*a*, 248*b*. Similarly, the illustrated grip surfaces 250*a*, 250*b* can be oriented further apart than the fastener apertures 248*a*, 248*b*.

The illustrated fastener apertures 248*a*, 248*b* can have a frustoconical shape on the surface opposite the handle base 230 to receive the fasteners 238*a*, 238*b* therein. The illustrated fastener apertures 248*a*, 248*b* can also have a recessed basin on the side engaging the handle base 230 surrounding the lower tip of the frustoconical shape. This recessed basin in the fastener apertures 248*a*, 248*b* receives the fastener receivers 244*a*, 244*b* on the handle base 230.

Alternatively to the illustrated embodiment, the fastener apertures 248*a*, 248*b* and the fastener receivers 244*a*, 244*b* can have a different orientation and placement, while still maintaining operational alignment with respect to each other. Alternatively still, the grip surfaces 250*a*, 250*b* can have a different shape, texture and orientation, while still maintaining its intended operational functionality. Alternatively still, the pull grips 232*a*, 232*b* and the handle base 230 can have different shapes and geometries entirely, while still functioning to releasably secure to each other. For example, alternative pull grips can secure to the outward facing regions of the handle base through insets and receivers or other methods of fastening understood by those of skill in the art.

Figure 10:
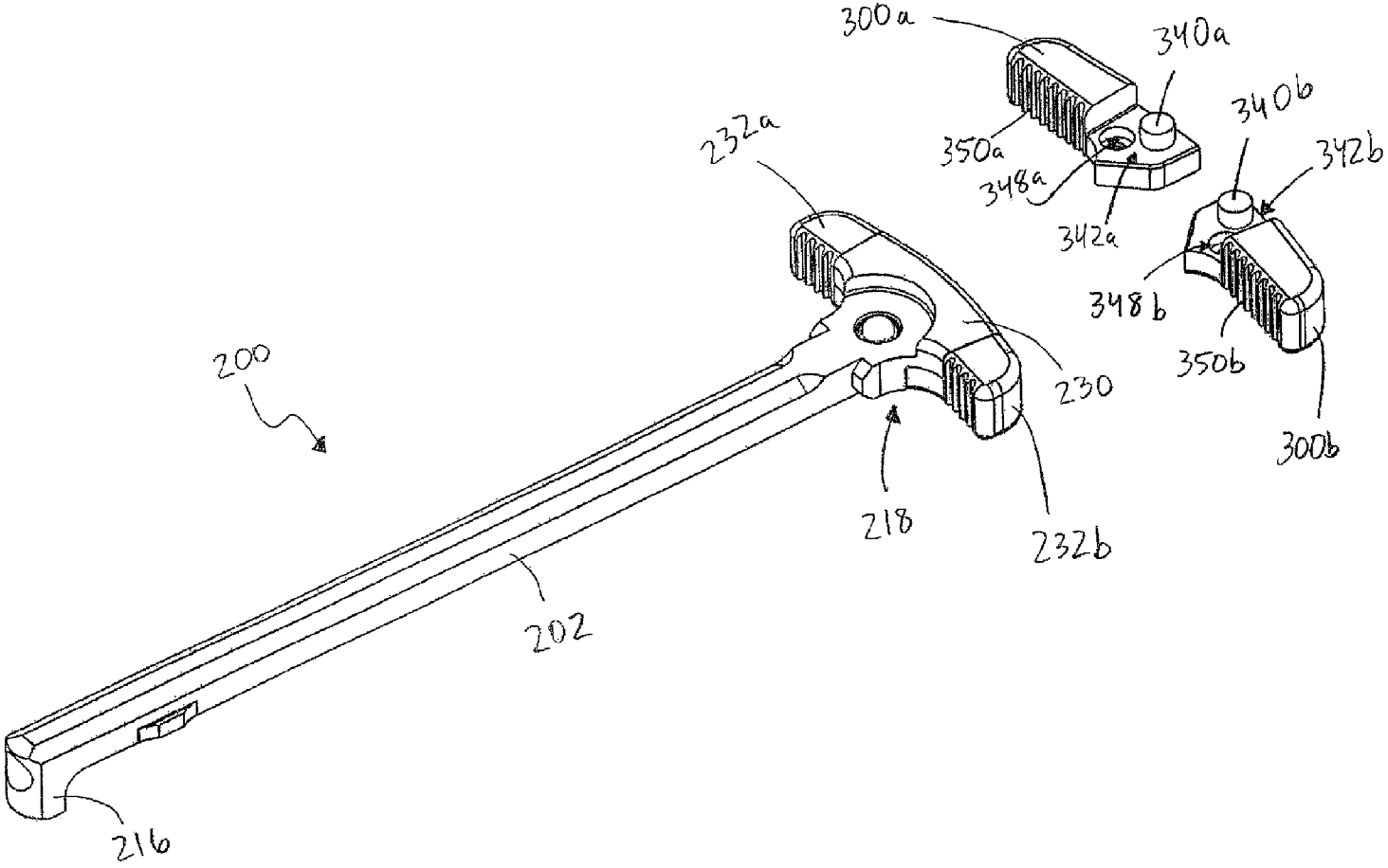
FIG. 10 is a distal upper perspective view of the modular charging handle shown in FIG. 6, and showing third and fourth example handles which can be secured to the handle.

FIG. 10 shows a distal upper perspective view of the modular functionality of the example charging handle 200 described in FIGS. 6-9. As illustrated, the charging handle 200 includes the elongated body 202 extending between the engagement end 216 and the pull end 218. The illustrated charging handle 200 includes a handle base 230 at the pull end 218. The illustrated handle base 230 modularly and interchangeably receives the pair of pull grips 232*a*, 232*b* described above.

The illustrated charging handle 200 can also receive different types of pull grips than the pull grips described in FIGS. 6-9. For example, the illustrating charging handle 200 can receive any type, shape, size or geometry of pull grips as long as those different pull grips can releasably secure to the a mounting structure, for example the handle base 230, on the charging handle. As illustrated, alternative pull grips 300*a*, 300*b* are shown to be operationally modular and interchangeable with the charging handle 200 because these alternative pull grips include a similar mounting geometry to the pull grips 232*a*, 232*b* described in FIGS. 6-9. As illustrated, the alternative pull grips 300*a*, 300*b* include mounting regions 342*a*, 342*b*, fastener apertures 348*a*, 348*b*, plug inserts 340*a*, 340*b* and grip surfaces 350*a*, 350*b*, similarly to the pull grips 300*a*, 300*b* described in FIGS. 6-9. The illustrated grip surfaces 350*a*, 350*b* can have textures that are similar to or different from the grip surfaces 250*a*, 250*b* described in FIGS. 6-9.

In an interchangeable and modular operation, the illustrated charging handle 200 can function with the pair of first and second pull grips 232*a*, 232*b*, or the pair of alternative third and fourth pull grips 300*a*, 300*b* (or handle elements).

Alternatively still, the illustrated charging handle 200 can function with one of the first or second pull grips 232*a*, 232*b* and one of the third or fourth alternative pull grips 300*a*, 300*b*. Alternatively still, the illustrated charging handle 200 can function with only one of the illustrated pull grips 232*a*, 232*b*, 300*a*, 300*b*.

The illustrated first and second pull grips 232*a*, 232*b* can have different shapes, geometries, orientations and sizes from the third and fourth alternative pull grips 300*a*, 300*b*. For example, the illustrated alternative pull grips 300*a*, 300*b* are longer than the first and second pull grips 232*a*, 232*b*, such that the alternative pull grips extend away from the pull end 218 of the charging handle 200 a greater distance than the first and second pull grips. In one example, the first and second pull grips 232*a*, 232*b* can have a length of between about 2.5 cm and about 3.5 cm, more preferably about 3 cm. In another example, the alternative pull grips 300*a*, 300*b* can have a length of between about 3.5 cm and about 4.5 cm, more preferably about 4 cm. However, the length of the pull grips 232*a*, 232*b*, 300*a*, 300*b* can be less than or greater than these ranges.

When assembled, the illustrated charging handle 200 and the desired pairing of mounted pull grips 232*a*, 232*b*, 300*a*, 300*b* are integrally rigid.

Alternatively still, additional example pull grips can each have different shapes from the other, for example cylindrical, triangular, rectangular, or ergonomic such as is illustrated in FIGS. 6-10. Depending on how a user prefers the charging handle to operate, it is contemplated that one mounted pull grip can have a first shape or geometry and the other mounted pull grip can have a different second shape or geometry.

Alternatively still, additional example pull grips can removably secure to an alternative handle base with a variety of different connectors other than as described. As would be understood by one of ordinary skill in the art, the pull grips can secure with any device providing releasable mechanical connection, for example snap-fit, friction fit, corresponding rotatable insert and receiver between the pull grip and the base, and the like. Also, additional example pull grips can removably secure to the handle base from a variety of orientations other than as described, for example along an axis that is different from the longitudinal axis.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

We claim:

1. A modular charging handle assembly comprising:

a charging handle body extending between a bolt engagement end and a pull end, the charging handle body being oriented along a longitudinal axis;

a base disposed at the pull end of the charging handle body and operatively connected thereto, the base comprising a pair of mounting guides set on either side of the longitudinal axis a pair of pull grips mateably, releasably and non-rotatably secured to the pair of mounting guides on either side of the longitudinal axis to provide ambidextrous operating that; and a manually-detachable, threaded fastener non-rotatably securing each pull grip to each respective mounting guide, thereby to provide a modular structure having pull grips that are manually changeable by a user.

2. The modular charging handle of claim 1, wherein the pair of pull grips include mounting structures configured to align with the pair of mounting guides.

3. The modular charging handle assembly of claim 1, wherein the pair of pull grips comprise two pull grips that are essentially identical.

4. The modular charging handle assembly of claim 1, wherein the pair of pull grips comprise pull grips having different dimensions from each other.

5. The modular charging handle assembly of claim 1, wherein the pair of pull grips comprise a textured grip surface for ergonomic operability.

6. The modular charging handle assembly of claim 1, wherein the pair of pull grips comprise an insert and the base mounting guides comprise a receiver for receiving the insert.

7. The modular charging handle assembly of claim 6, wherein the base mounting guide receivers comprise a bore.

8. The modular charging handle assembly of claim 1, wherein the base mounting guides comprise an insert and the pair of pull grips comprises a receiver for receiving the insert.

9. The modular charging handle assembly of claim 8, wherein the base mounting guide insert comprises an internal fastener receiver and the pair from the pull grip receivers comprise a fastener aperture that aligns with the base mounting guide internal fastener receiver.

10. The modular charging handle of claim 1, wherein the distal bolt engaging end comprises a lip.

* * * * *